US010636607B2

(12) United States Patent
Zhou et al.

(10) Patent No.: US 10,636,607 B2
(45) Date of Patent: Apr. 28, 2020

(54) HIGH VOLTAGE COMPACT FUSED DISCONNECT SWITCH DEVICE WITH BI-DIRECTIONAL MAGNETIC ARC DEFLECTION ASSEMBLY

(71) Applicant: EATON INTELLIGENT POWER LIMITED, Dublin OT (IE)

(72) Inventors: Xin Zhou, Wexford, PA (US); Peter John Theisen, West Bend, WI (US); Paul J. Rollmann, Menomonee Falls, WI (US); Matthew Rain Darr, Edwardsville, IL (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 133 days.

(21) Appl. No.: 15/855,367

(22) Filed: Dec. 27, 2017

(65) Prior Publication Data

US 2019/0198278 A1 Jun. 27, 2019

(51) Int. Cl.
*H01H 89/04* (2006.01)
*H01H 1/20* (2006.01)
(Continued)

(52) U.S. Cl.
CPC ..... *H01H 89/04* (2013.01); *H01H 1/20* (2013.01); *H01H 9/104* (2013.01); *H01H 9/443* (2013.01);
(Continued)

(58) Field of Classification Search
CPC ..... H01H 9/443; H01H 21/16; H01H 33/182; H01H 85/38; H01H 89/04; H01H 2085/383; H01H 2085/386; H01H 1/20; H01H 9/104; H01H 85/0241; H01H 85/165; H01H 85/203
(Continued)

(56) References Cited

U.S. PATENT DOCUMENTS 685,766 A 11/1901 Jones
2,677,032 A 4/1954 Wells
(Continued)

FOREIGN PATENT DOCUMENTS

AU 6805098 A 12/1998
CA 905466 A 7/1972
(Continued)

OTHER PUBLICATIONS

International Search Report and Written Opinion for International Application PCT/US2016/020199, dated May 24, 2016, 11 pages.
(Continued)

*Primary Examiner* — Jacob R Crum
(74) *Attorney, Agent, or Firm* — Armstrong Teasdale LLP

(57) ABSTRACT

A fused disconnect switch device includes a housing defining an interior volume, and a current path. An arc interruption assembly is located in the interior volume and includes a shell, and a conductor in electrical communication with the current path. At least one arc plate is located between the magnets and the conductor. The magnets cooperate to generate a magnetic field facilitating an interruption of a first arc between the conductor and the first side of the arc chamber and a second arc between the conductor and the second side of the arc chamber.

20 Claims, 11 Drawing Sheets

(51) Int. Cl.

| | |
|---|---|
| ***H01H 33/18*** | (2006.01) |
| ***H01H 85/20*** | (2006.01) |
| ***H01H 9/10*** | (2006.01) |
| ***H01H 9/44*** | (2006.01) |
| ***H01H 85/38*** | (2006.01) |
| *H01H 85/165* | (2006.01) |
| *H01H 85/02* | (2006.01) |
| *H01H 21/16* | (2006.01) |

(52) U.S. Cl.
CPC ..... *H01H 33/182* (2013.01); *H01H 85/203* (2013.01); *H01H 85/38* (2013.01); *H01H 21/16* (2013.01); *H01H 85/0241* (2013.01); *H01H 85/165* (2013.01); *H01H 2085/386* (2013.01)

(58) Field of Classification Search
USPC ..... 337/44
See application file for complete search history.

(56) References Cited

U.S. PATENT DOCUMENTS

| | | | | |
|---|---|---|---|---|
| 3,684,849 | A | 8/1972 | Zubaty | |
| 4,367,448 | A | 1/1983 | Nishizako | |
| 4,451,718 | A | 5/1984 | Yamagata et al. | |
| 4,514,716 | A | 4/1985 | Vincent De Araujo | |
| 4,516,003 | A * | 5/1985 | Yoshiyasu | H01H 9/30 218/150 |
| 4,752,660 | A | 6/1988 | Yokoyama et al. | |
| 4,962,406 | A | 10/1990 | Walker et al. | |
| 5,291,167 | A | 3/1994 | Richter | |
| 5,588,876 | A | 12/1996 | Hayes et al. | |
| 5,592,079 | A | 1/1997 | Scheel | |
| 5,633,483 | A | 5/1997 | Oster et al. | |
| 5,793,275 | A | 8/1998 | Iversen | |
| 5,920,131 | A | 7/1999 | Platt et al. | |
| 6,008,459 | A | 12/1999 | Faber et al. | |
| 6,188,332 | B1 | 2/2001 | Scarlata | |
| 6,194,984 | B1 | 2/2001 | Kappel et al. | |
| 6,498,326 | B1 | 12/2002 | Knappe | |
| 6,700,466 | B1 | 3/2004 | Yamamoto et al. | |
| 6,809,282 | B2 | 10/2004 | Fasano | |
| 6,812,435 | B2 | 11/2004 | Schilling | |
| 6,838,785 | B2 | 1/2005 | Schilling | |
| 7,474,194 | B2 | 1/2009 | Darr et al. | |
| 7,495,540 | B2 | 2/2009 | Darr et al. | |
| 7,924,136 | B2 | 4/2011 | Darr et al. | |
| 8,106,733 | B2 | 1/2012 | Nakasuji et al. | |
| 8,334,740 | B2 | 12/2012 | Annis et al. | |
| 8,519,292 | B2 | 8/2013 | Domejean | |
| 8,661,719 | B2 | 3/2014 | Hughes et al. | |
| 8,835,814 | B2 | 9/2014 | Apetauer et al. | |
| 9,552,951 | B2 | 1/2017 | Douglass | |
| 2003/0224737 | A1 | 12/2003 | Yokoji et al. | |
| 2004/0150504 | A1 | 8/2004 | Nicholson | |
| 2006/0055498 | A1 | 3/2006 | Darr et al. | |
| 2006/0125596 | A1 | 6/2006 | Darr et al. | |
| 2007/0188290 | A1 | 8/2007 | Nakasuji et al. | |
| 2008/0296264 | A1 | 12/2008 | Schulz et al. | |
| 2009/0128280 | A1 | 5/2009 | Darr et al. | |
| 2009/0321233 | A1 * | 12/2009 | Ferree | H01H 1/2041 200/244 |
| 2011/0169599 | A1 | 7/2011 | Darr et al. | |
| 2011/0193675 | A1 | 8/2011 | Darr et al. | |
| 2011/0221563 | A1 | 9/2011 | Su et al. | |
| 2012/0268233 | A1 | 10/2012 | Weber et al. | |
| 2013/0057369 | A1 | 3/2013 | Yano et al. | |
| 2013/0075367 | A1 | 3/2013 | Eriksson | |
| 2013/0106543 | A1 | 5/2013 | Isozaki et al. | |
| 2013/0112655 | A1 | 5/2013 | Theisen et al. | |
| 2013/0228551 | A1 | 9/2013 | Asokan et al. | |
| 2013/0264311 | A1 | 10/2013 | Lang et al. | |
| 2014/0014622 | A1 | 1/2014 | Naka et al. | |
| 2014/0061160 | A1 | 3/2014 | Juds et al. | |
| 2014/0263186 | A1 * | 9/2014 | Gerving | H01H 9/36 218/26 |
| 2015/0027984 | A1 | 1/2015 | Mattlar et al. | |
| 2015/0054605 | A1 | 2/2015 | Kubono et al. | |
| 2016/0260571 | A1 * | 9/2016 | Douglass | H01H 89/04 |
| 2017/0229274 | A1 | 8/2017 | Shea et al. | |
| 2017/0330720 | A1 | 11/2017 | Shea | |

FOREIGN PATENT DOCUMENTS

| | | | |
|---|---|---|---|
| CA | 2820116 | A1 | 6/2012 |
| CN | 201117605 | Y | 9/2008 |
| CN | 101315852 | A | 12/2008 |
| CN | 201430111 | Y | 3/2010 |
| CN | 102592910 | A | 7/2012 |
| CN | 202736866 | U | 2/2013 |
| DE | 2434897 | A1 | 2/1976 |
| DE | 102012214881 | A1 | 2/2014 |
| DE | 102012223168 | A1 | 3/2014 |
| EP | 2605265 | A1 | 6/2013 |
| EP | 2690639 | A1 | 1/2014 |
| ES | 2437580 | T3 | 1/2014 |
| GB | 619239 | A | 3/1949 |
| IN | 697/MUM/2011 | | 7/2013 |
| JP | H111329206 | A | 11/1999 |
| JP | H111339605 | A | 12/1999 |
| JP | 2002260475 | A | 9/2002 |
| JP | 2007324038 | A | 12/2007 |
| JP | 2008300094 | A | 12/2008 |
| JP | 2011150983 | A | 8/2011 |
| JP | 2012146472 | A | 8/2012 |
| JP | 5303022 | B2 | 10/2013 |
| JP | 2013235748 | A | 11/2013 |
| JP | 5368150 | B2 | 12/2013 |
| JP | 2013242977 | A | 12/2013 |
| JP | 2014056731 | A | 3/2014 |
| KR | 101031975 | B1 | 5/2011 |
| KR | 101214007 | B1 | 12/2012 |
| WO | 2011127654 | A1 | 10/2011 |
| WO | 2014039162 | A1 | 3/2014 |

OTHER PUBLICATIONS

International Search Report and Written Opinion for International Application PCT/US2016/022627, dated Jun. 20, 2016, 16 pages.
International Search Report and Written Opinion for International Application No. PCT/US2014/029521, dated Jul. 14, 2017, 16 pages.

* cited by examiner

HIGH VOLTAGE COMPACT FUSED DISCONNECT SWITCH DEVICE WITH BI-DIRECTIONAL MAGNETIC ARC DEFLECTION ASSEMBLY

BACKGROUND OF THE INVENTION

The field of the invention relates generally to circuit protection devices for electrical power systems, and more specifically to fused disconnect switch devices for protecting higher voltage direct current (DC) circuitry.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and open one or more circuits through the fuse to prevent electrical component damage.

A variety of fused disconnect switch devices are known in the art wherein fused output power may be selectively switched from a power supply without having to remove the fuse. Existing fused disconnect switch devices, however, have not completely met the needs of those in the art and improvements are desired.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Fusible circuit protection devices are sometimes utilized in an array on electrical panels and the like in an electrical power distribution system. Each fusible circuit protection device includes a single fuse or multiple fuses depending on the application, and each fusible circuit protection device protects load-side circuitry from overcurrent conditions and the like on the line-side circuitry that, if not interrupted, may potentially damage load-side systems and components.

One type of fusible circuit protection device is a fused disconnect switch. In such fused disconnect switch devices, switch contacts are provided to make or break electrical connection to and through their respective fuses. Fused disconnect switch devices are advantageous from a number of perspectives, but are nonetheless disadvantaged in certain applications.

For example, while conventional fused disconnect switch devices are satisfactory for breaking alternating current (AC) circuitry by operation of a switch contact, the switching of higher voltage DC circuitry is problematic. When switched under load, electrical arcing is typically generated at the switch contacts. Unlike AC current, where such arcing has an opportunity to extinguish at any current zero crossing of the alternating voltage wave, there is no current zero crossing in a DC for the arc to extinguish. This constant DC voltage potential further tends to create sustained arcing conditions that will erode the switch contacts very quickly. Sustained high temperatures associated with DC arcing conditions contribute to further switch mechanism degradation, and perhaps may even lead to catastrophic failure of the fused disconnect switch device if not carefully controlled. Of course, as the voltage of the DC circuitry increases, electrical arcing issues become more severe.

To safely contain arc energy inside the housings of fused disconnect switch devices the known fused disconnect switch devices are relatively large. Larger fused disconnect switch devices tend to be more expensive than smaller ones, and following general trends to reduce component size in the electrical industry smaller fused disconnect switch devices are desired in the marketplace. Balancing the need to contain arc energy with a desire for smaller fused disconnect switch devices, however, presents practical challenges. Improvements to fused disconnect switch devices are accordingly desired that facilitate a more compact and lower cost solution to protect higher voltage DC circuitry than has heretofore been provided.

Figure 1:
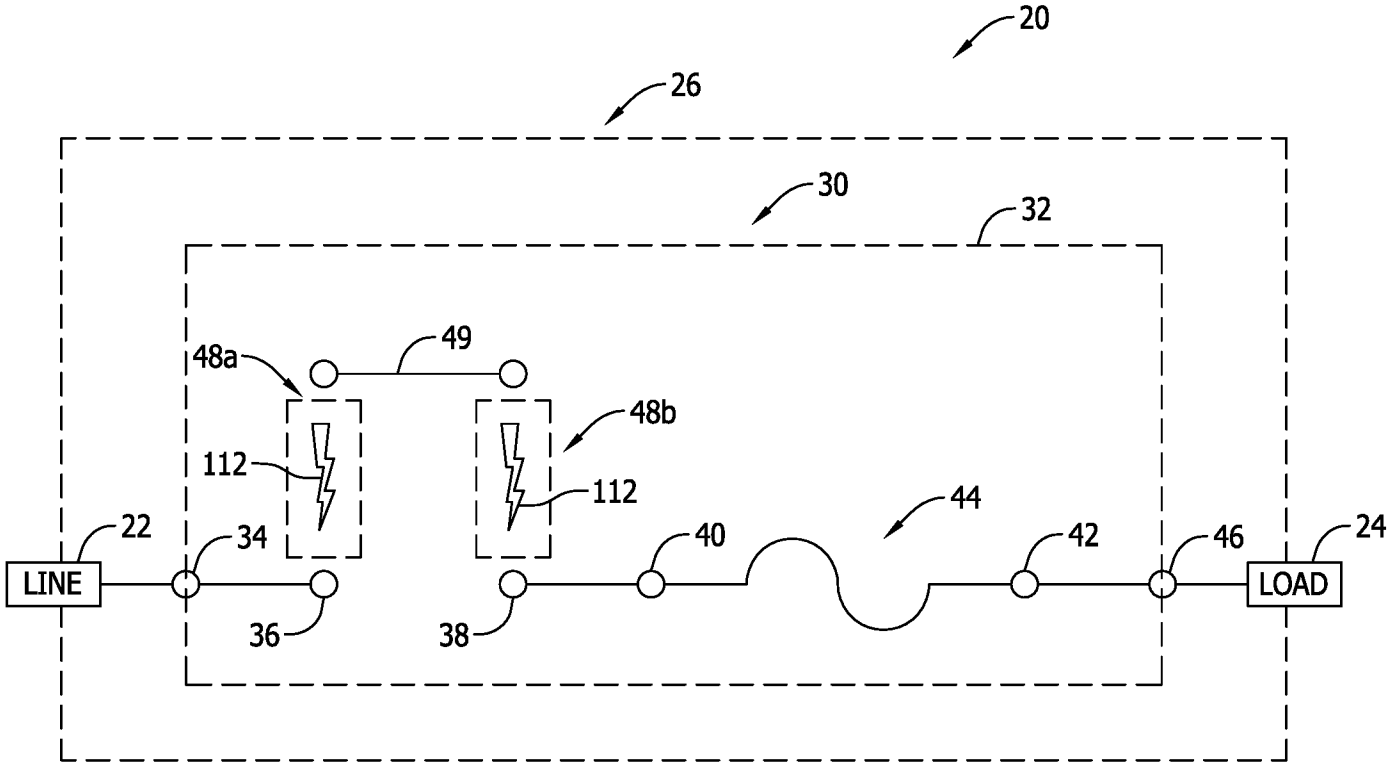
FIG. 1 is a circuit schematic of an exemplary electrical power distribution system including a fused disconnect switch device formed in accordance with an exemplary embodiment of the present invention.

FIG. 1 schematically illustrates an electrical power system 20 for supplying electrical power from a power supply or line-side circuitry 22 to power receiving or load-side circuitry 24. In contemplated embodiments the line-side circuitry 22 and load-side circuitry 24 may be associated with a panelboard 26 that includes a fused disconnect switch device 30. While one fused disconnect switch device 30 is shown, it is contemplated that in a typical installation a plurality of fused disconnect switch devices 30 would be provided in the panelboard 26 that each respectively receives input power from the line-side circuitry 22 via, for example, a bus bar (not shown), and outputs electrical power to one or more of various different electrical loads 24 associated with branch circuits of the larger electrical power system 20.

The fused disconnect switch device 30 may be configured as a compact fused disconnect switch device such as those described further below that advantageously combine switching capability and enhanced fusible circuit protection in a single, compact switch housing 32 that is expressly contrasted with known fuse and circuit breaker combinations. As shown in FIG. 1, the fused disconnect switch device 30 defines a circuit path through the switch housing 32 between the line-side circuitry 22 and the load-side circuitry 24. The circuit path of the fused disconnect switch device 30 includes, as shown in FIG. 1, a line-side connecting terminal 34, switchable contacts 36 and 38, fuse contact terminals 40 and 42, a removable overcurrent protection fuse 44 connected between the fuse contact terminals 40 and 42, and a load-side connecting terminal 46. Each of the elements 34, 36, 38, 40, 42 and 46 that define the circuit path are included in the housing 32 while the overcurrent protection fuse 44 is separately provided but used in combination with the housing 32 and the conductive elements 34, 36, 38, 40, 42 and 46 in the switch housing 32.

The switch contacts 36, 38 are stationary in the switch housing 32. The switch contacts 36 and 38, via mating engagement or disengagement of corresponding movable contacts as shown, can be electrically connected or isolated from the line-side connecting terminal 34 and the fuse contact terminal 40 and hence connect or disconnect the load-side circuitry 24 from the line-side circuitry 22 when desired. When the fused disconnect switch device 30 is electrically connected to energized line-side circuitry 22, and also when the switch contacts 36, 38 and associated movable contacts are closed and the fuse 44 is intact, electrical current flows through the line-side connecting terminal 34 of the fused disconnect switch device 30 and through the switch contacts 36 and 38, to and through the fuse contact terminal 40 and the fuse 44 to the fuse contact terminal 42, and to and through the load-side connecting terminal 46 to the load. When the switch contacts 36, 38 and associated movable contacts are opened, the contacts 36, 38 are electrically isolated from one another, and an open circuit is established between them in the switch housing 32 of the fused disconnect switch device 30 and the load-side circuitry 24 is electrically isolated or disconnected from the line-side circuitry 22 via the fused disconnect switch device 30. When the contacts 36, 38 are again electrically connected via closing of the movable contacts, electrical current flow resumes through the current path in the fused disconnect switch device 30 and the load-side circuitry 24 is again electrically connected to the line-side circuitry 22 through the fused disconnect switch device 30.

When the overcurrent protection fuse 44 is subjected to a predetermined electrical current condition when the switch contacts 36, 38 and associated movable contacts are closed, however, the overcurrent protection fuse 44, and specifically the fusible element (or fusible elements) therein is configured to permanently open or fail to conduct current any longer, creating an open circuit between the fuse contact terminals 40 and 42. When the overcurrent protection fuse 44 opens in such a manner, current flow through the fused disconnect switch device 30 is interrupted and possible damage to the load-side circuitry 22 is avoided. In one contemplated embodiment, the fuse 44 may be a rectangular fuse module such as a CUBEFuse™ power fuse module commercially available from Bussmann by Eaton of St. Louis, Mo. In other embodiments, the overcurrent protection fuse 44 may be a cylindrical fuse such as a Class CC fuse, a so-called Midget fuse, or an IEC 10×38 fuse also available from Bussmann by Eaton.

Because the overcurrent protection fuse 44 permanently opens, the overcurrent protection fuse 44 must be replaced to once again to complete the current path between the fuse contact terminals 40 and 42 in the fused disconnect switch device 30 such the power can again be supplied to the load-side circuitry 24 via the fused disconnect switch device 30. In this aspect, the fused disconnect switch device 30 is contrasted with a circuit breaker device that is known to provide overcurrent protection via a resettable breaker element. At least in part because the device 30 does not involve or include a resettable circuit breaker element in the circuit path completed in the switch housing 32, the fused disconnect switch device 30 is considerably smaller than an equivalently rated circuit breaker device providing similar overcurrent protection performance.

As compared to conventional arrangements wherein fusible devices are electrically connected in series with separately packaged switching elements, the fused disconnect switch device 30 is relatively compact and can provide substantial reduction in size and cost while providing comparable, if not superior, circuit protection performance.

When the compact fused disconnect switch devices 30 are utilized in combination in a panelboard 26, current interruption ratings of the panelboard 26 may be increased while the size of the panelboard 26 may be simultaneously reduced. The compact fused disconnect switch device 30 may advantageously accommodate fuses 44 without involving a separately provided fuse holder or fuse carrier that is found in certain types of conventional fused disconnect switch devices. The compact fused disconnect switch device 30 may also be configured to establish electrical connection to the fuse contact terminals 40, 42 without fastening of the fuse 44 to the line and load-side terminals with separate fasteners, and therefore provide still further benefits by eliminating certain components of conventional fused disconnect constructions while simultaneously providing a lower cost, yet easier to use fusible circuit protection device 30.

Typical compact fused disconnect switch devices such as Compact Circuit Protection (CCP) devices available from Bussmann by Eaton of St. Louis, Mo. provide the functionality and benefits described thus far in relation to the switch housing 32 and the associated terminals and contacts, but are nonetheless limited in some aspects for particular applications involving higher voltage direct current (DC) power systems. More specifically, typical compact fused disconnect switch devices of otherwise similar type can safely break a DC circuit having a voltage potential of about 125 VDC or less. For DC power systems operating above 125 VDC, the arc voltage associated with electrical arcing as the switch contacts 36, 38 and associated movable contacts are opened or closed likely is lower than the source voltage and is not able to interrupt the DC current, therefore the arc energy increases considerably and exceeds the ability of typical compact fused disconnect switch devices to reliably withstand.

Moreover, typical compact fused disconnect switch devices are polarity dependent and can safely switch the DC current flowing only in a predetermined direction through the device. Accordingly, the safe operation of the device depends on its proper connection to the circuit being protected. Specifically, the line-side and load-side connections of the device must be matched with the line-side and load-side connections of the protected circuit. That is, the line-side terminal is the input terminal for the device and the load-side terminal is the output terminal. If the fused disconnect switch is connected in reverse (which may happen inadvertently), such a switch will not operate as designed. This is particularly so in the aspect of interrupting electrical arcing in conventional fused disconnect switch devices.

Compact fused disconnect switch devices are now desired that may operate not only at very high DC voltages such as 400 VDC, 600 VDC and 1000 VDC, but also operate to effect bi-directional switching that is not polarity dependent. Moreover, certain industry standard DC switching and interruption performance may be required such as the DC switching and interruption performance required by UL Standard 98. Compact fused disconnect switch devices are now desired that may operate at both low level currents such as the system rated current and high level currents such as 600% of the rated current in very high DC voltage systems. Such very high DC voltage systems include the aforementioned system ratings of 400 VDC, 600 VDC and 1000 VDC.

To address arcing concerns of 600 VDC operation and above as well as bi-directional switching operation that is not polarity dependent, the compact fused disconnect switch device 30 of the invention includes a set of arc chambers 48*a*, 48*b* and a movable switch element 49 that carries movable contacts on each end. Arc chambers 48*a*, 48*b* include a set of magnets arranged to provide an arc deflecting force to more quickly extinguish the electrical arc in each chamber 48*a*, 48*b* as switching occurs in the switch housing 32.

Moreover, in some embodiments, arc chambers 48*a*, 48*b* and the respective stationary switch contacts 36 and 38 therein may include a stationary turn-back conductor terminal structure. Such a stationary turn-back conductor not only provides additional magnetic force induced by the current itself which drives the arc off the stationary contacts 36 and 38 onto the stationary turn-back conductors and stretches the arc to generate higher arc voltage, but also provides space to create an effective barrier between the arc chambers 48*a*, 48*b*. As the movable switch element 49 is opened and closed under a high voltage load, electrical arcing occurs between the movable contacts carried on the switch element 49 and the respective stationary switch contacts 36 and 38. The first arc chamber 48*a* and a second arc chamber 48*b* are arranged to respective contain electrical arcing in each chamber. A magnetic arc deflecting force is generated in each chamber 48*a*, 48*b* proximate each of the stationary switch contacts 36 and 38 and the ends of the movable switch element 49 to more effectively interrupt the electrical arc as described below.

Electrical arcing is divided over the two locations corresponding to each contact 36 and 38 and the corresponding movable contacts such that electrical arcing is less severe and shorter in duration in each chamber 48*a*, 48*b* than it otherwise would be, allowing the compact fused disconnect switch device 30 to safely and capably operate to disconnect the line-side circuitry 22 and electrically isolate the load-side circuitry 24 at much higher operating DC voltages beyond the capability of known fused disconnect switch devices. Magnetic arc deflection features further provide for effective arc interruption as described below. Voltage potentials as high as 1000 VDC may be reliably and safely disconnected by virtue of the arc chambers 48.

Figure 2A:
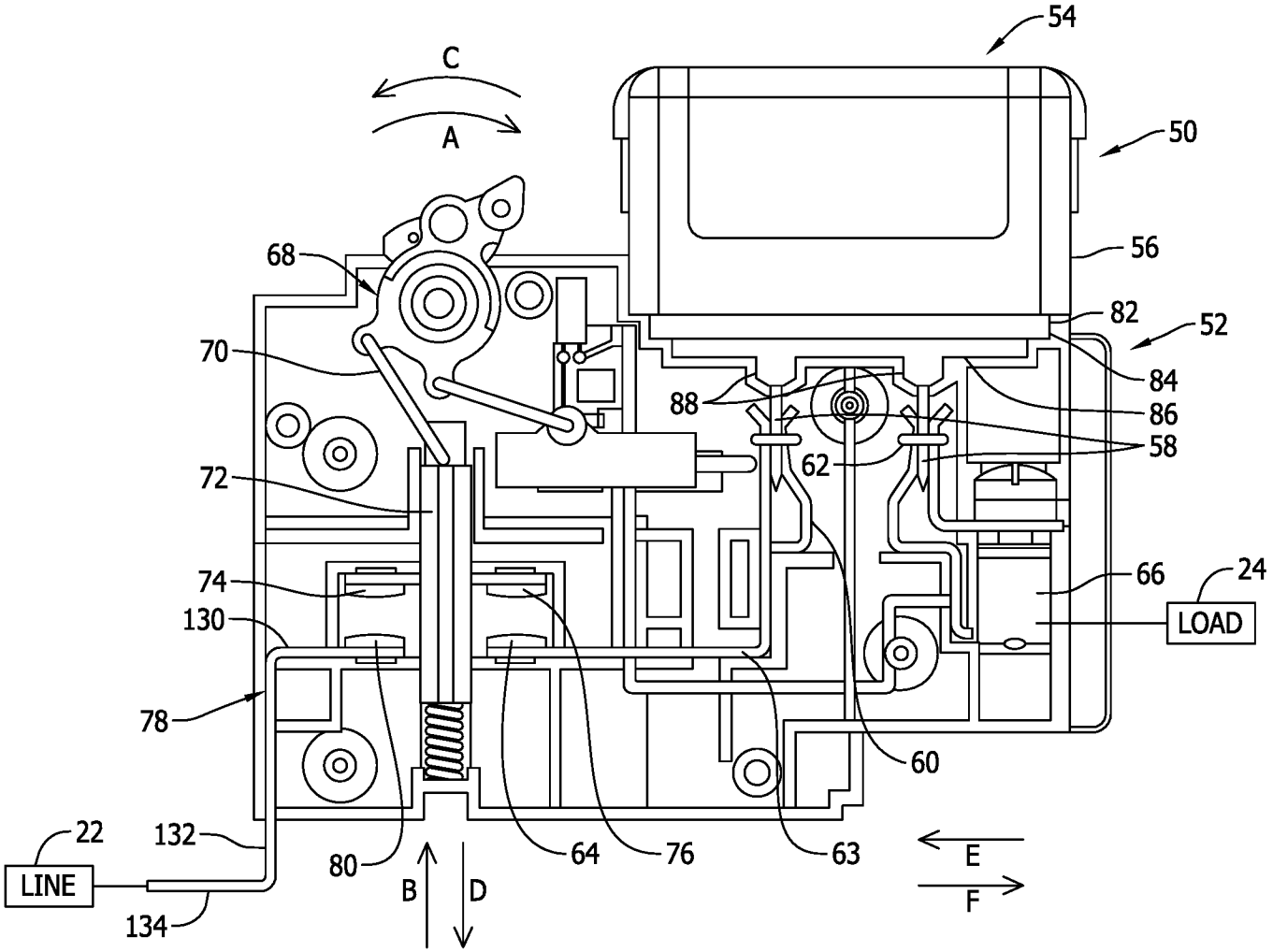
FIG. 2A is a partial longitudinal side elevational view of an embodiment of a fused disconnect switch device for the electrical power distribution system shown in FIG. 1.

FIG. 2A illustrates a more specific example of a compact fused disconnect switch device assembly 50 that provides the functionality described above in relation to the compact fused disconnect switch device 30. As shown in FIG. 2A, the fused disconnect switch device assembly 50 includes a non-conductive switch housing 52 configured or adapted to receive a retractable rectangular fuse module 54, and having an internal volume including the conductive elements that provide the switch. The fuse module 54 is a known assembly including a rectangular housing 56, and terminal blades 58 extending from the housing 56. A primary fuse element or fuse assembly is located within the housing 56 and is electrically connected between the terminal blades 58. Such fuse modules 54 are known and in one embodiment the rectangular fuse module is a CUBEFuse™ power fuse module commercially available from Bussmann by Eaton of St. Louis, Mo.

A line-side fuse clip 60 may be situated within the switch housing 52 and may receive one of the terminal blades 58 of the fuse module 54. A load-side fuse clip 62 may also be situated within the switch housing 52 and may receive the other of the fuse terminal blades 58. The line-side fuse clip 60 may be electrically connected to a line-side terminal 63 including a stationary switch contact 64. The load-side fuse clip 62 may be electrically connected to a load-side terminal 66.

A rotary switch actuator 68 is further provided on the switch housing 52, and is mechanically coupled to an actuator link 70 that, in turn is coupled to a sliding actuator bar, sometimes referred to as movable contact carrier 72. The contact carrier 72 carries a movable contact bridge with a pair of switch contacts 74 and 76. A load-side terminal 78 including a stationary contact 80 is also provided. Electrical connection to power supply or line-side circuitry 22 may be accomplished in a known manner using the line-side terminal 78, and an electrical connection to load-side circuitry 24 may be accomplished in a known manner using the load-side terminal 66. A variety of connecting techniques are known (e.g., box lug terminals, screw clamp terminals, spring terminals, and the like) and may be utilized. The configuration of the line and load-side terminals 78 and 66 shown are exemplary only, and in the example of FIG. 2A the line and load-side terminals 78 and 66 are differently configured. In the embodiment illustrated, the line-side terminal 78 is configured as a panel mount clip while the load-side terminal 66 is configured as a box lug terminal. In alternative embodiments, however, the load-side terminal 66 and line-side terminal 78 may be configured to be the same (e.g., both may be configured as box lug terminals or as another terminal configuration as desired).

Disconnect switching may be accomplished by rotating the switch actuator 68 in the direction of arrow A, causing the actuator link 70 to move the sliding bar 72 linearly in the direction of arrow B and moving the switch contacts 74 and 76 toward the stationary contacts 64 and 80. Eventually, the switch contacts 74 and 76 become mechanically and electrically engaged to the stationary contacts 64 and 80 and a circuit path may be closed through the fuse 54 between the line and load terminals 78 and 66 when the fuse terminal blades 58 are received in the line and load-side fuse clips 60 and 62. This position, wherein the movable switch contacts 74 and 76 are mechanically and electrically connected to the stationary switch contacts 64 and 80 is referred to herein as a closed position wherein the fused disconnect switch device 50 electrically connects the line-side circuitry 22 and the load-side circuitry 24 through the fuse 54.

Additionally, the fuse module 54 may be simply plugged into the fuse clips 60, 62 or extracted therefrom to install or remove the fuse module 54 from the switch housing 52. The fuse housing 56 projects from the switch housing 52 and is open and accessible so that a person can grasp the fuse housing 56 by hand and pull it in the direction of arrow D to disengage the fuse terminal blades 58 from the line and load-side fuse clips 60 and 62 such that the fuse module 54 is completely released from the switch housing 52. Likewise, a replacement fuse module 54 can be grasped by hand and moved toward the switch housing 52 to engage the fuse terminal blades 58 to the line and load-side fuse clips 60 and 62.

Such plug-in connection and removal of the fuse module 54 advantageously facilitates quick and convenient installation and removal of the fuse 54 without requiring separately supplied fuse carrier elements and without requiring tools or fasteners common to other known disconnect devices. Also, the fuse terminal blades 58 project from a lower side of the fuse housing 56 that faces the switch housing 52. Moreover, the fuse terminal blades 58 extend in a generally parallel manner projecting away from the lower side of the fuse module 54 such that the fuse housing 56 (as well as a person's hand when handling it) is physically isolated from the conductive fuse terminals 58 and the conductive line and load-side fuse clips 60 and 62. The fuse module 54 is therefore touch safe (i.e., may be safely handled by hand without risk of electrical shock) when installing and removing the fuse 54.

Additionally, the disconnect device 50 is rather compact and can easily occupy less space in a fusible panelboard assembly, for example, than conventional in-line fuse and circuit breaker combinations. In particular, CUBEFuse™ power fuse modules occupy a smaller area, sometimes referred to as a footprint, in the panel assembly than non-rectangular fuses having comparable ratings and interruption capabilities. Reductions in the size of panelboards are therefore possible, with increased interruption capabilities.

In ordinary use, the circuit is preferably connected and disconnected at the switch contacts 64, 74, 76 and 80 rather than at the fuse clips 60 and 62. Electrical arcing that may occur when connecting/disconnecting the circuit may be contained at a location away from the fuse clips 60 and 62 to provide additional safety for persons installing, removing, or replacing fuses. By opening the disconnect device 50 with the switch actuator 68 before installing or removing the fuse module 54, any risk posed by electrical arcing or energized metal at the fuse and housing interface is eliminated. The disconnect device 50 is accordingly believed to be safer to use than many known fused disconnect switches.

Figure 2B:
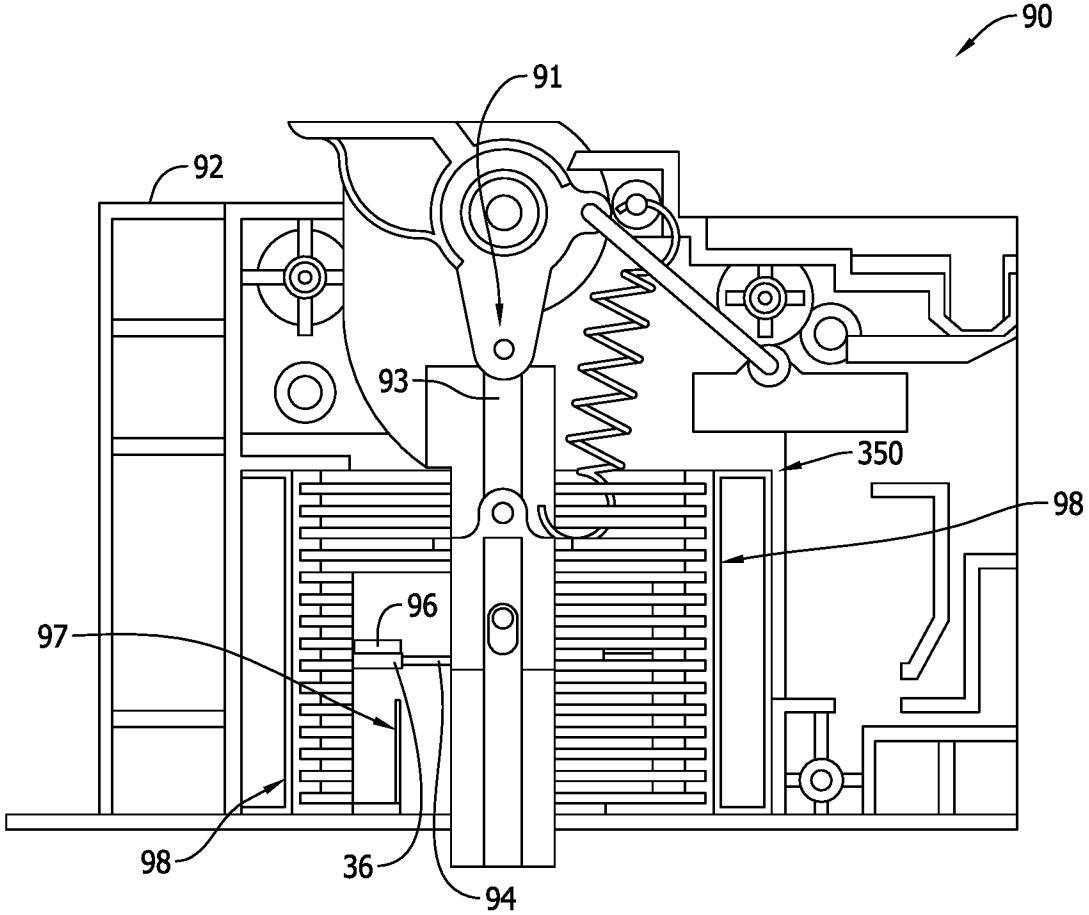
FIG. 2B is a perspective view of an embodiment of a fused disconnect switch device for the electrical power distribution system shown in FIG. 1.

FIG. 2B illustrates an enhanced compact fused disconnect switch device 90. A rotary switch actuator 91 is further provided on the switch housing 92, and is mechanically coupled to an actuator link 93 that, in turn is coupled to a sliding actuator bar, sometimes referred to as a contact carrier 94 that is movable along a linear axis within an internal volume of the switch housing. As depicted the rotary switch actuator 91 is in a closed position. The actuator bar 94 carries movable switch contacts 96 that are similar in operation to those described above.

When the rotary switch actuator 91 is closed an electrical connection between contact 96 and stationary contacts on stationary turn-back conductor 97 exists. When the rotary switch actuator 91 is open, there is no electrical connection between contact 96 and stationary contact on stationary turn-back conductor 97. The stationary turn-back conductor 97 is disposed in an arc chamber 98. The structure of stationary turn-back 97 not only provides additional magnetic force induced by the current itself which drives the arc off the stationary contacts 36 and 38 onto the stationary conductors and stretches the arc to generate higher arc voltage, but also provides space to allow for an effective barrier within arc chamber 98. As depicted, stationary turn-back conductor 97 is located in the center of arc chamber 98. However, in other embodiments stationary turn-back conductor 97 can be alternatively located or have any structure that facilitates moving the arc off stationary contacts onto stationary turn-back conductor 97 and stretching the arc between stationary turn-back conductor 97 and arc chamber 98.

Figure 3A:
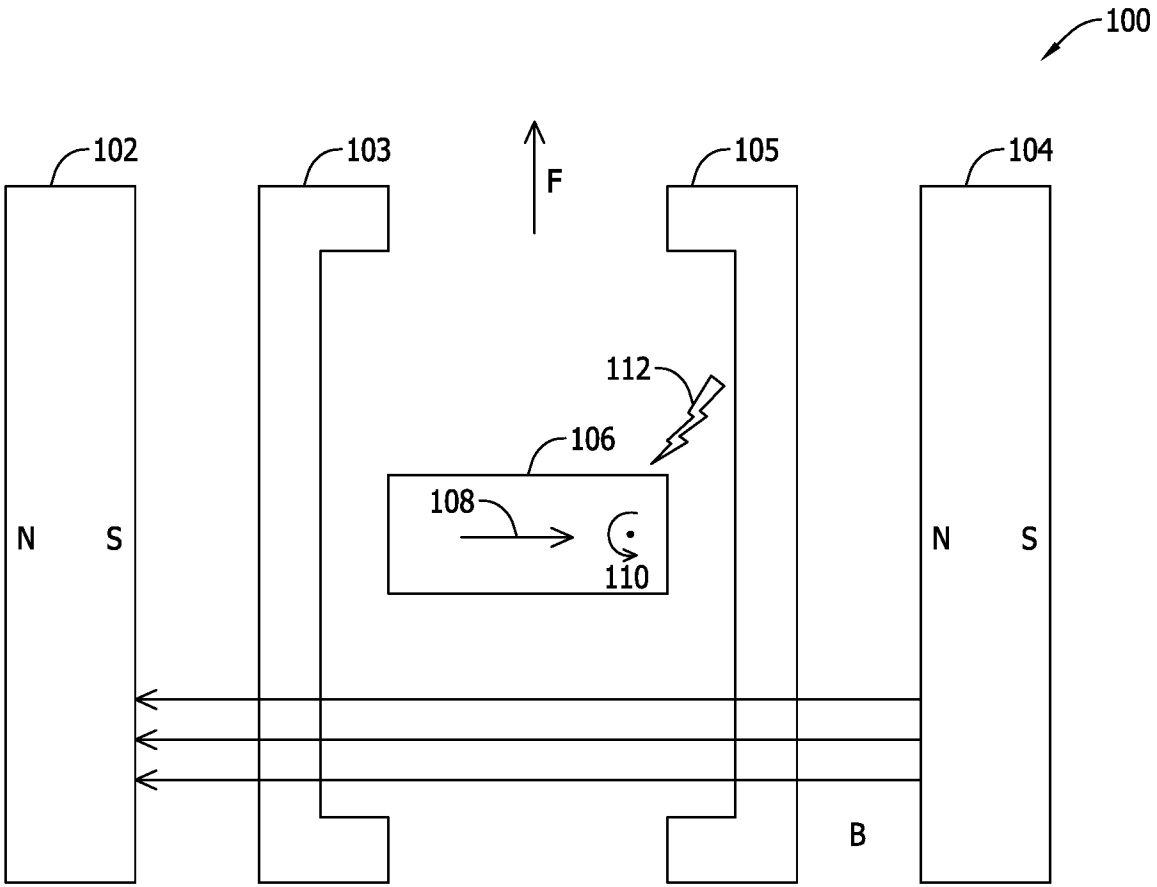
FIG. 3A is a schematic view of a portion of a magnet assembly for the fused disconnect switch device shown in FIG. 2B.

FIG. 3A is a schematic view of a portion of a magnet assembly 100 for the fused disconnect switch device 90 to provide magnetic arc deflection that enhances performance capability in, for example, DC power systems operating above 125 VDC. The magnet assembly 100 generates a magnetic force to drive an arc into a stack of arc plates and split the arc into multiple short arcs in series to to interrupt the DC circuit. Meanwhile the stack of arc plates also effectively dissipates an increased amount of electrical arc energy associated with electrical arcing as the switch contacts 74 and 76 are opened or closed that exceeds the ability of typical compact fused disconnect switch devices to reliably withstand. Using the principles of the magnet assembly 100 described below, compact fused disconnect switch devices 50 may be realized that may safely and reliably operate in electrical power systems operating at 600 VDC or greater, and potentially much greater voltages for use in DC voltage power systems operating at 1000 VDC. The interrupting capability of the fused disconnect switch device 90 accordingly may greatly increase via the implementation of the magnet assembly 100.

As seen in FIG. 3A, the magnet assembly 100 includes a pair of magnets 102, 104 and a pair of arc plates 103 and 105 arranged on each side of a conductor 106 that may correspond to the contact carrier 94 carrying the movable switch contacts 96 in the device 90 described above. In contemplated embodiments, each magnet 102, 104 is a permanent magnet that respectively imposes a magnetic field B having a first polarity between the pair of magnets 102, 104, and the conductor 106, corresponding to the contact carrier 94, is situated in the magnetic field B. Further, arc plates 103 and 105 are situated between magnets 102 and 104 in order to cool and dissipate arc energy in an electric arc originating from conductor 106. Arc plates 103 and 105 are square or u-shaped in design in order to maximize surface area, enable effective cooling, and reducing wear and erosion of arc chamber wall material. As shown in FIG. 3A, the magnet 102 has opposing poles S and N and the magnet 104 also has opposing poles S and N. Between the pole N of magnet 102 and the pole S of magnet 104 the magnetic field B is established and generally oriented in the direction shown. The magnetic field B has a strength dependent on the properties and spacing of the magnets 102 and 104. The magnetic field B may be established in a desired strength depending on the magnets utilized. The magnetic field B in contemplated embodiments is constant and is maintained regardless of whether the movable switch contacts 96 (FIG. 2B) are opened or closed.

When electrical current flows through the conductor 106 in a direction 108 and more in a direction to the right in the view plane of FIG. 3A, the current flow through a switch contact carried by the conductor 106 in the example shown is perpendicular to the plane of the page. The current flow through the switch contact induces a separate magnetic field 110 which extends circumferentially around the switch contact. The strength or intensity of the magnetic field 110 is, however, dependent on the magnitude of the current flowing through the conductor. The greater the current magnitude, the greater the strength of the magnetic field 110 that is induced. Likewise, when no current flows through the conductor 106, no magnetic field 110 is established.

Below the conductor 106 in the example illustrated in FIG. 3A, the magnetic field 110 and the magnetic field B generally oppose one another and at least partly cancel one another, while above the conductor as shown in FIG. 3A, the magnetic field 110 and the magnetic field B combine to create a magnetic field of increased strength and density. The concentrated magnetic field above the conductor 106 in FIG. 3A produces a mechanical arc deflecting force F acting on the current flow. The arc deflecting force F is normal to the magnetic field B. The arc deflecting force F may be recognized as a Lorenz force having magnitude F determined by the following relationship:

$$F=IL\times B \quad (1)$$

It should now be evident that the magnitude of the force can be varied by applying different magnetic fields, different amounts of current, and different lengths (L) of conductor 106. The orientation of the arc deflecting force F is shown to extend in the vertical direction in the plane of the page of FIG. 3A, but in general can be oriented in any direction desired according to Fleming's Left Hand Rule, a known mnemonic in the field.

Briefly, Fleming's Left Hand Rule illustrates that when an external magnetic field (e.g., the magnetic field B) is applied across a flow of current in a given direction, a force (e.g., the force F) that is oriented perpendicularly both to the magnetic field and also to the direction of the current flow is generated. As such, the left hand can be held so as to represent three mutually orthogonal axes on the thumb, first finger and middle finger. Each finger represents one of the current, the magnetic field B and the arc deflecting force F generated in response. As one illustrative example, and considering the example shown in FIG. 3A, the first finger may represent the direction of the magnetic field B (e.g., to the left in FIG. 3A), the middle finger may represent may represent the direction of flow of the current (e.g. Into the plane of the page of FIG. 3A), and the thumb represents the arc deflecting force F.

By orienting the current flow in different directions through the magnetic field B, and also by orienting the magnetic field B in different directions, arc deflecting forces F extending in directions other than the arrow F can be generated. Within the switch housing 52 of the device 50 or the switch housing 92 of the device 90, magnetic forces F can accordingly be directed in a particular direction to assist in interrupting electrical arcing as the stationary and movable contacts are engaged and disengaged. For example, and according to Fleming's Left Hand Rule, if the current flow in the direction 108 was reversed, such current flow through the switch contact is out of the plane of the paper instead of into the plane of the paper as previously described in relation to the FIG. 3A while keeping the magnetic field B oriented as shown in FIG. 3A (i.e., toward the left in FIG. 3A), the arc deflecting force F generated would be oriented in a direction opposite to the arc deflecting force F as shown (i.e., toward the bottom of the page in FIG. 3A). Likewise, if the magnetic field B was oriented vertically instead of horizontally as illustrated in FIG. 3A, arc deflecting forces F could be generated in horizontal directions according to Fleming's Left Hand Rule instead of the vertically oriented forces of the preceding examples. Regardless, in the context of the disconnect switch devices 30 or 90 described above, at the locations of the switch contacts 36 and 38 (FIG. 1) or a switch contact 96 (FIG. 2B) or the corresponding contacts in the device of FIG. 3, as the movable switch contacts are opened or closed the arc deflecting force F can deflect electrical arcs 112 and considerably reduce arcing time and severity. In particular, the arc deflecting force F is oriented so as to cause electrical arcing to be deflected in a direction toward an arc plate, increasing the path length of an electrical arc until it contacts the arc plates and splits into short arcs between the arc plates, limiting and dissipating the arc energy, until the arc is weakened to the point of extinction.

Figure 3B:
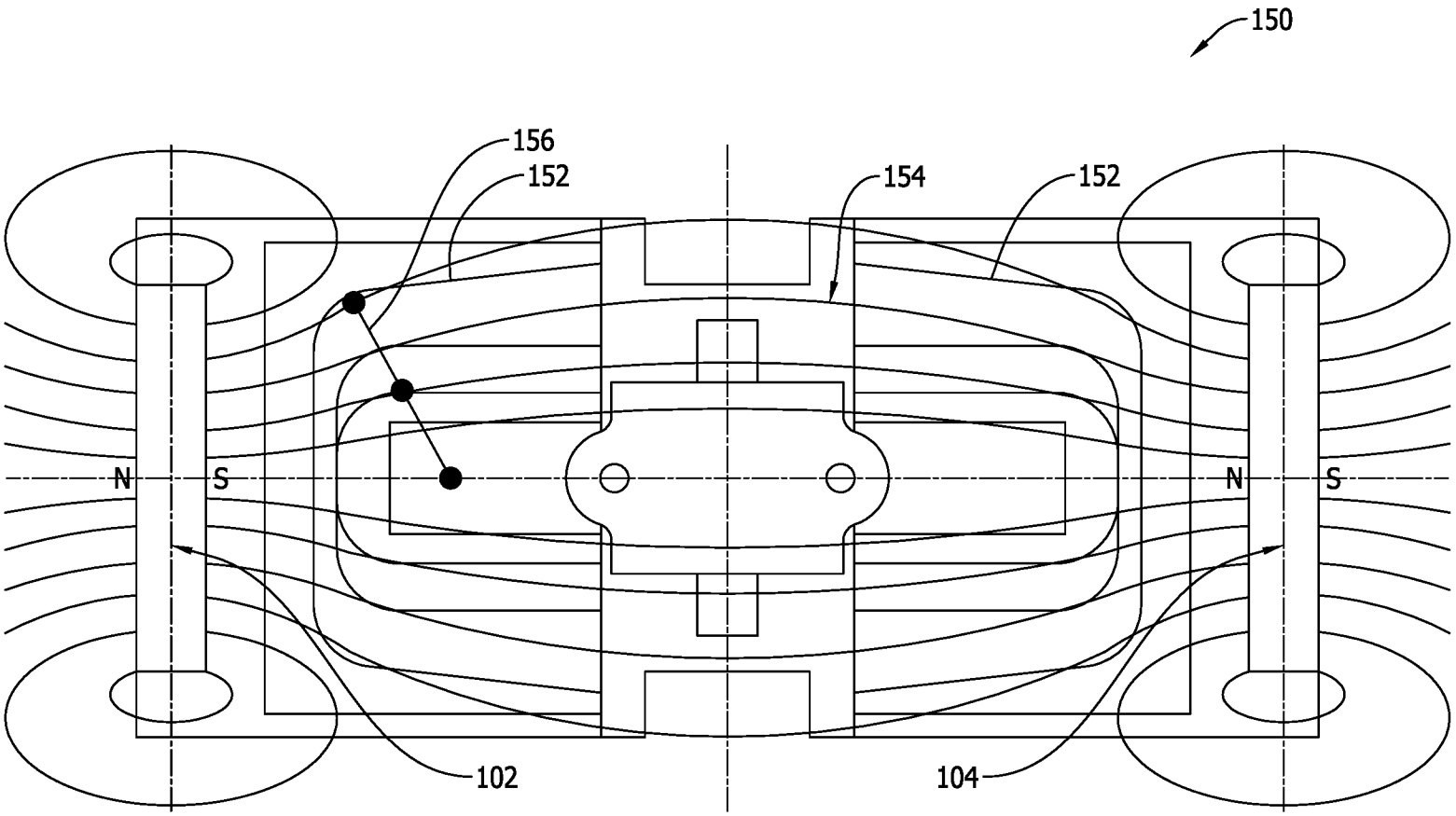
FIG. 3B is another schematic view of the portion of the magnet assembly of FIG. 3A.

FIG. 3B illustrates a magnet assembly 150 that includes a pair of magnets 102 and 104 effecting arc deflection forces in arc chambers surrounding movable contacts on each end of a moving conductor. The assembly 150 also provides arc plates 152 and magnetic field 154. Considering that the current flowing through the contacts at both ends of the conductor flows in opposite directions, the magnets provide arc deflection force that drives electrical arc at each location toward the arc plates in each chamber. In contemplated embodiments, an organic curved shape of arc plates 152 improves effective cooling of an arc, and reduces wear and erosion of arc chamber wall material. However, arc plates 152 may assume any alternative form or shape that enables fused disconnect switch device 50 to function as described herein. When the movable switch contact is opened or closed the force induced by magnetic field 154 can deflect electrical arcs 156 as they occur, considerably reducing arcing time and severity. It is noted in the arrangement of FIG. 3B that a single pair of magnets 102, 104 operate to deflect the arc in the first chamber and the second chamber.

Figure 4A:
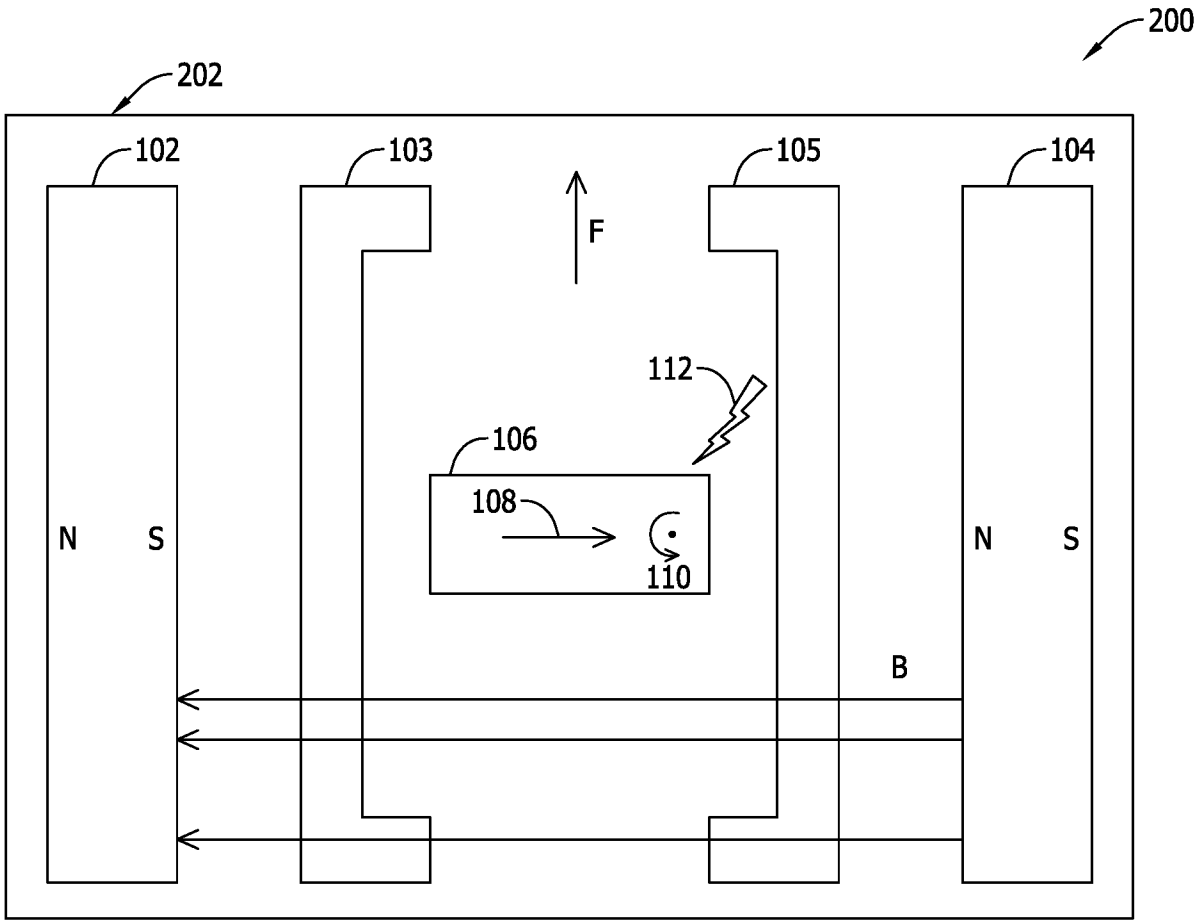
FIG. 4A is a schematic view of a portion of an alternative magnet assembly for the fused disconnect switch device shown in FIG. 2B that includes a ferromagnetic material shroud.

FIG. 4A is a schematic view of a portion of a magnet assembly 200 for the fused disconnect switch device 90 to provide magnetic arc deflection that enhances performance capability in, for example, DC power systems operating above 125 VDC. The magnet assembly 200 is similar to the implementation of the magnet assembly 100 (shown in FIG. 3A) with the addition of a magnetic shroud 202. In some embodiments the magnetic shroud 202 can also be a ferromagnetic shroud. The magnetic shroud 202 may be made from steel, iron, neodymium or any other type of magnet or magnetic material that enables magnetic shroud 202 to strengthen the magnetic field with the magnet assembly 200 or otherwise enable fused disconnect switch device 50 to function as described herein. The magnetic shroud 202 effectively strengthens the magnetic fields produced by the magnets and improves arc interruption performance.

The magnet assembly 200 includes a pair of magnets 102, 104 and a pair of arc plates 103 and 105 arranged on each side of a conductor 106 that may correspond to the contact carrier 94 carrying the movable switch contacts 96 in the device 90 described above. In contemplated embodiments, each magnet 102, 104 is a permanent magnet that respectively imposes a magnetic field B having a first polarity between the pair of magnets 102, 104, and the conductor 106 is situated in the magnetic field B. Further, arc plates 103 and 105 are situated between magnets 102 and 104 in order to attract and dissipate an electric arc originating from conductor 106. Arc plates 103 and 105 are square or u-shaped in design in order to maximize surface area, enabling effective cooling, and reducing wear and corrosion of arc chamber wall material. As shown in FIG. 4A, the magnet 102 has opposing poles S and N and the magnet 104 also has opposing poles S and N. Between the pole N of magnet 102 and the pole S of magnet 104 the magnetic field B also indicated as 106 is established and generally oriented in the direction as shown. The magnetic field B has a strength dependent on the properties and spacing of the magnets 102 and 104.

The magnetic field B may be established in a desired strength depending on the magnets utilized. The magnetic field B in contemplated embodiments is constant and is maintained regardless of whether the switch contacts 96 are opened or closed. By utilizing a magnetic shroud 202, magnetic field B is greatly strengthened for a given pair of magnets 102 and 104. For example, an otherwise identical magnet assembly 100 with the addition of the magnetic shroud 202 can dissipate an arc with a greater electrical potential than without the magnetic shroud 202. In further example, the magnetic shroud 202 can enable a smaller sized magnet assembly 200 for a given arc voltage potential. In contemplated embodiments, the magnetic shroud 202 can be fabricated from a ferromagnetic material such as steel. The magnetic shroud 202 can fully enclose or partially enclose the magnet assembly 200 in order to strengthen the magnetic field B.

Figure 4B:
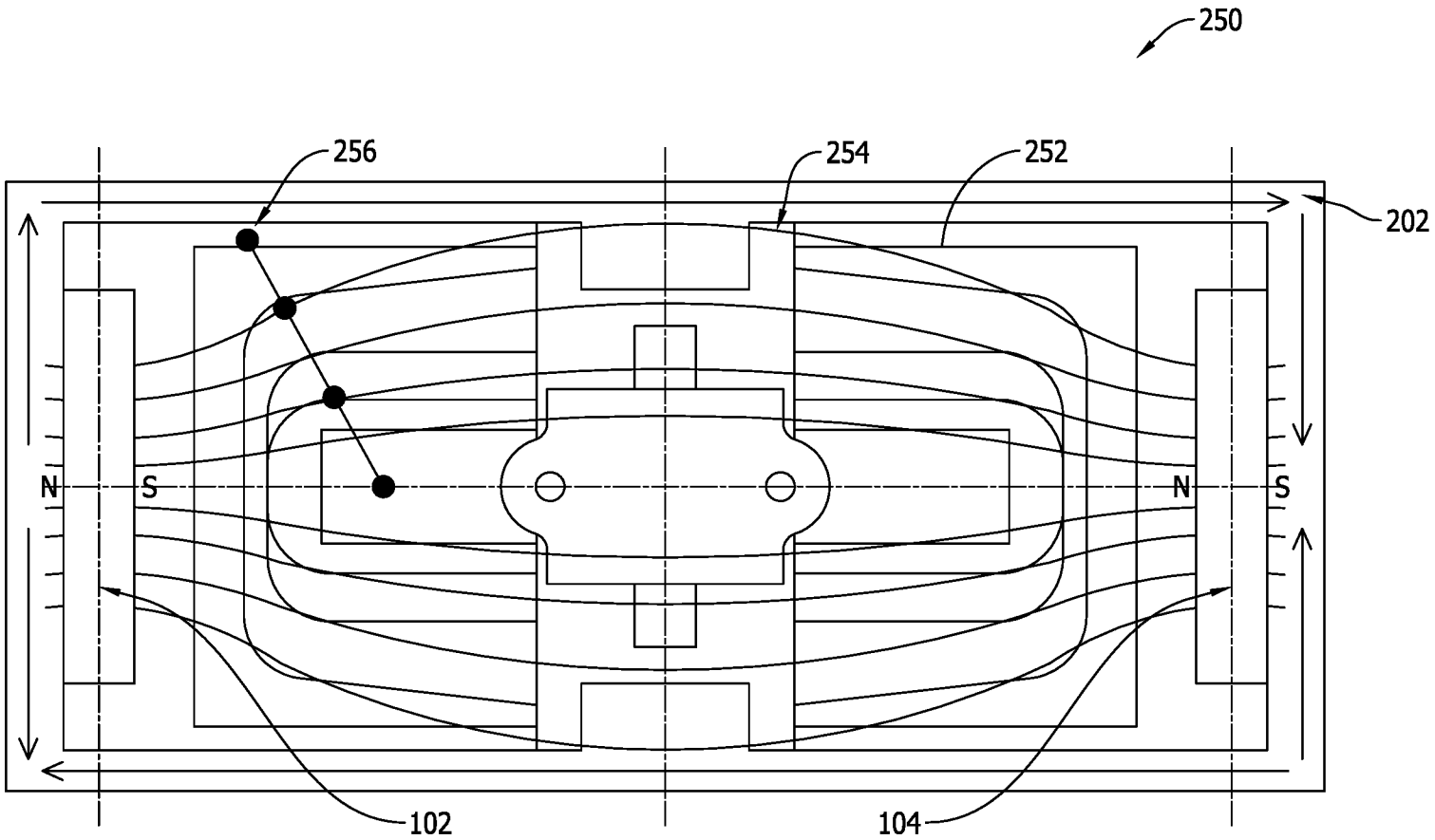
FIG. 4B is another schematic view of the portion of the magnet assembly of FIG. 4A.

FIG. 4B illustrates a magnet assembly 250 that includes a pair of magnets 102 and 104, and magnetic shroud 202. The magnet assembly 250 also provides arc plates 252 and magnetic field 254. In contemplated embodiments, the organic curved shape of arc plates 252 can enable effective cooling, and reduce wear and erosion of arc chamber wall material. However, arc plates 252 can take any form or shape that enables fused disconnect switch device 50 to function as described herein. When the movable switch contact is opened or closed the force induced by magnet field 254 can deflect electrical arcs 256 when they occur, considerably reducing arcing time and severity.

Figure 5A:
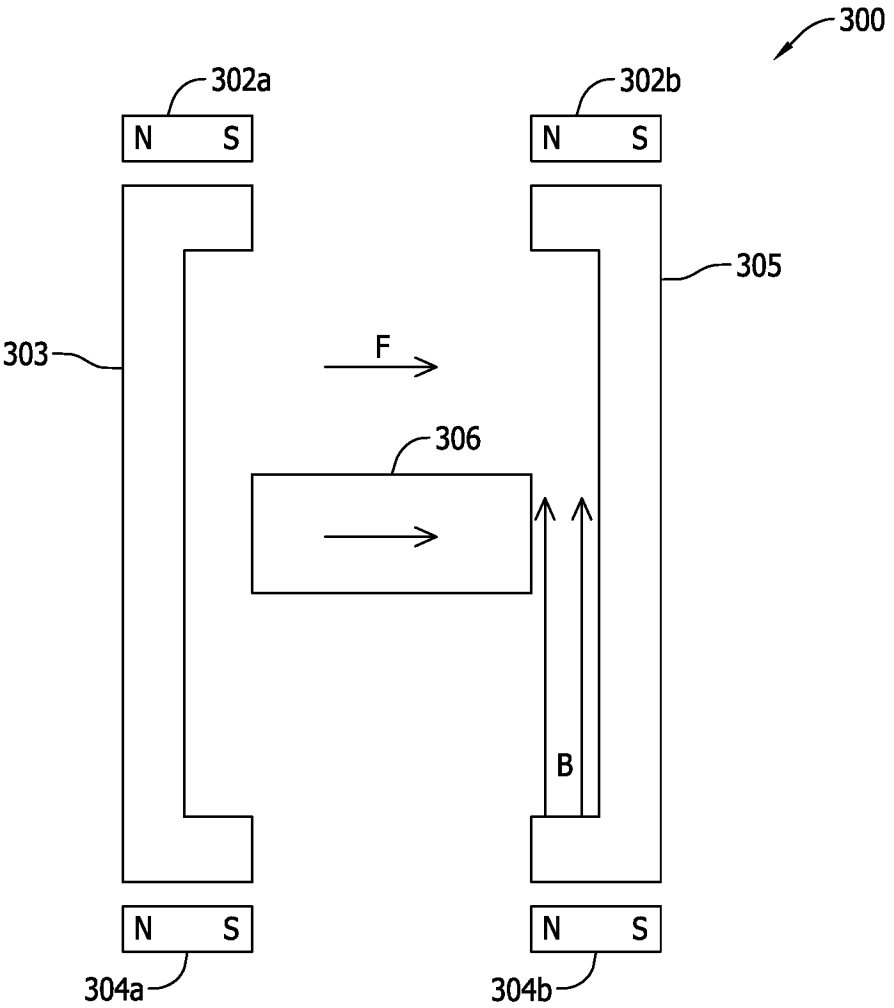
FIG. 5A is a schematic view of a portion of an alternative magnet assembly for the fused disconnect switch device shown in FIG. 2B.

FIG. 5A is a schematic view of a portion of a magnet assembly 300 for the fused disconnect switch device 50 or 90 to provide magnetic arc deflection that enhances performance capability in, for example, DC power systems operating above 125 VDC.

The magnet assembly 300 includes pairs of magnets 302, 304 and a pair of arc plates 103 and 105 arranged on each side of a movable conductor 306 that carries movable contacts on each end as described above. The magnets 302, 304 are arranged generally perpendicularly to the magnet arrangement shown in FIG. 3A in the assembly. In contemplated embodiments, each magnet 302*a*, 302*b*, 304*a*, and 304*b* is a permanent magnet that respectively imposes a magnetic field B having a first polarity between the pairs of magnets 302, 304, and the conductor 306 is situated in the magnetic field B. Further, arc plates 303 and 305 are situated between pairs of magnets 302 and 304 in order to attract and dissipate an electric arc originating from conductor 106. Arc plates 303 and 305 are square or u-shaped in design in order to maximize surface area, enabled effective cooling, and reducing wear and corrosion of arc chamber wall material. As shown in FIG. 5A, magnets 302*a*, 302*b*, 304*a*, and 304*b* each have opposing poles S and N. Between the pole N of magnet 302 and the pole S of magnet 304 the magnetic field B also indicated as 306 is established and generally oriented in the direction shown. The magnetic field B has a strength dependent on the properties and spacing of the pair of magnets 302 and 304.

Figure 5B:
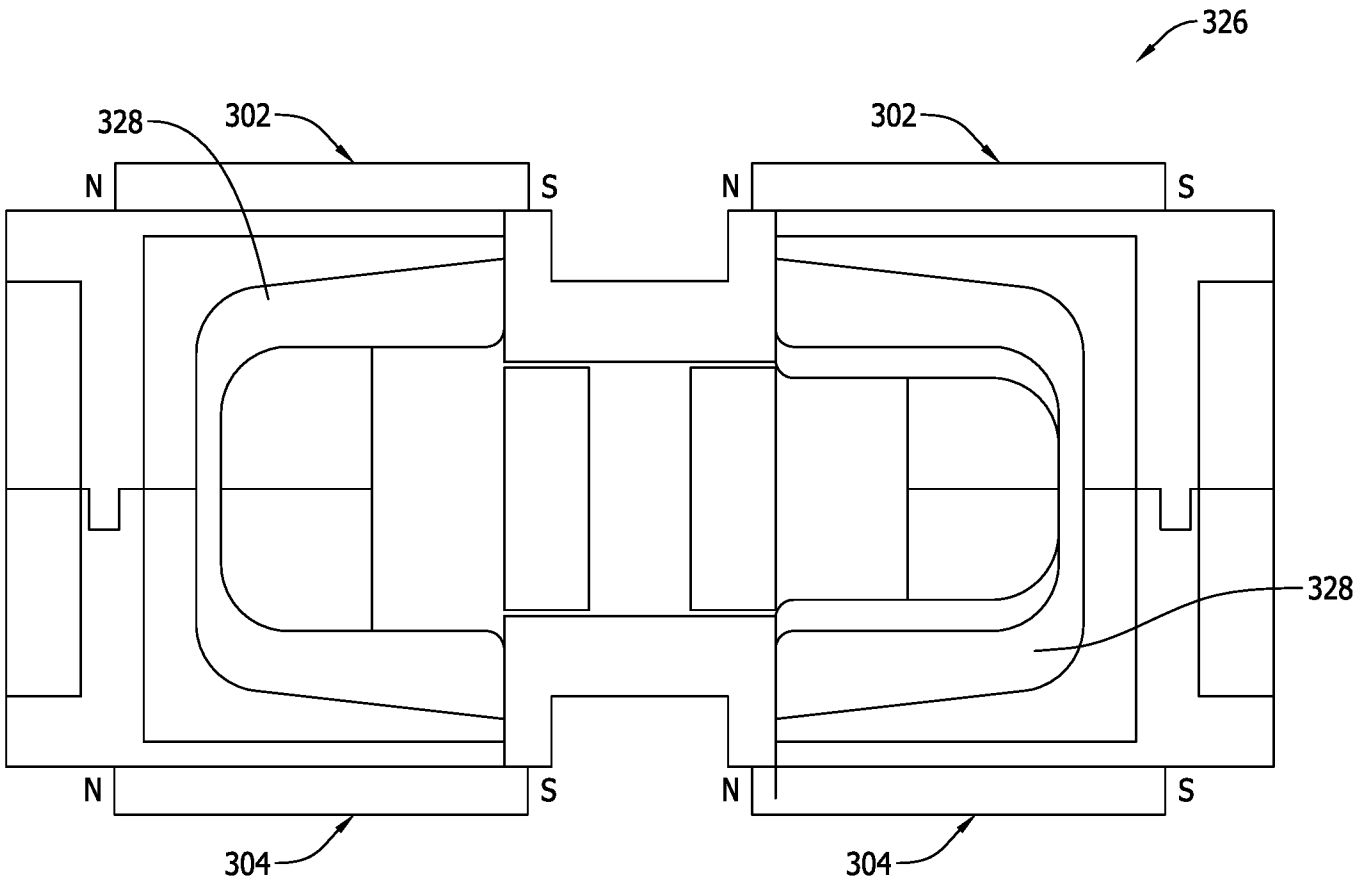
FIG. 5B is another schematic view of the portion of the magnet assembly of FIG. 5A.

FIG. 5B illustrates another embodiment of magnet assembly 326 that includes pairs of magnets 302 and 304 and arc plates 328 in each arc chamber. In contemplated embodiments, the organic curved shape of arc plates 328 can enable effective cooling, and reduce wear and erosion of arc chamber wall material. However, arc plates 328 can take any form or shape that enables fused disconnect switch device 90 to function as described herein. When the movable switch contact is opened or closed the force induced by the magnetic field produced by magnets 302 and 304 will deflect electrical arcs when they occur, considerably reducing arcing time and severity. Again, the magnetic arc deflection force, realized by the first and second pairs of magnets, cause an arc occurring in each chamber to deflect toward the arc plates in each chamber, increasing the path length of the arc and allowing more efficient interruption of the arc with the arc plates. In this embodiment, each pair of magnets affects electrical arcing in only one of the two arc chambers. Compared to the arrangement of FIG. 3B, providing dual sets of magnets as in FIG. 5B operating over a smaller distance may improve the magnetic field and force generated in each arc chamber.

Figure 6:
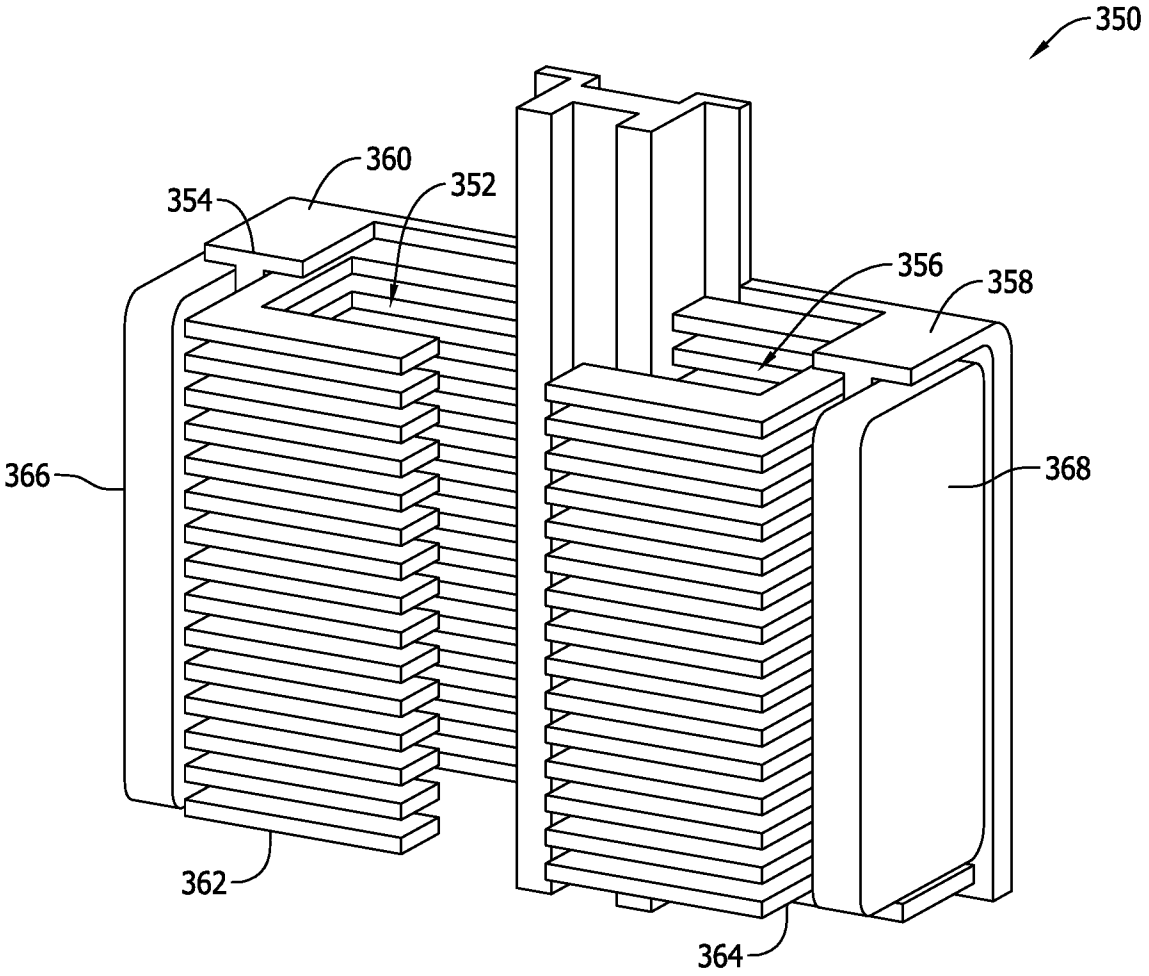
FIG. 6 is a perspective view of an exemplary arc chamber assembly for the fused disconnect switch device shown in FIG. 2B.

FIG. 6 is a perspective view of an exemplary arc chamber assembly 350 for fused disconnect switch device 90. The arc chamber assembly 350 defines an internal volume including a first chamber 352 at a first side 354 and a second chamber 356 at a second side 358. In some embodiments the first side 354 and second side 358 can also be referred to as the first section and the second section. The arc chamber assembly further includes a first shell 360, a second shell (not shown), a movable conductor 94 carrying the movable switch contacts 96 (FIG. 3A), a first number of arc plates 362, a second number of arc plates 364, a first magnet 366 and a second magnet 368. Alternatively, arc chamber assembly 350 can include any number of arc plates and magnets that enable fused disconnect switch device 50 to function as described herein.

In the exemplary embodiment, the movable conductor 94 that carries the movable switch contacts 96 is located to pass through the first chamber 352 and the second chamber 356. The arc plates 362, 364 include a leading edge that defines a channel through each chamber as shown. The exemplary first and second number of arc plates 362 and 364 are of a "square" or u-shaped design. The square design facilitates an effective surface area for arc dissipation. Because the first and second number of arc plates 362 and 364 can be subjected to heat loading, the maximal surface of the square design facilitates more efficient cooling of arc plates 362 and 364. Because the arc plates 362 and 364 are more effectively cooled, erosion due to heat or electrical loading is reduced thereby increasing the life of the fused disconnect switch device 50.

The first chamber 352 corresponds in location to an arc at a first electrical potential originating from the conductor 94 in between the first chamber 352 and the second chamber 356 and terminating at the first side 354 of the first chamber. Specifically, the magnets 366 and 368 cooperate to form a magnetic field extending across the first chamber. Likewise, the second chamber 356 corresponds in location to an arc at a second electrical potential originating from the conductor 94. Furthermore, the magnets 366 and 368 cooperate to form the magnetic field extending across the second chamber. In contemplated embodiments the magnets 366 and 368 are permanent magnets, and more specifically are rare earth magnets such as neodymium magnets.

The arc chamber assembly 350 is formed with integrated pockets or receptacles that receive the magnets 366, 368 as shown. When the first shell 360 is assembled with a second shell, the magnets 366, 368 are each respectively received in a portion of each shell and the arc plates 362 and 364 are captured in place to generate the desired magnetic field across the shell. In the example shown, the magnets 366, 368 are positioned about equidistantly from a center of the arc chamber assembly, and thus would be equidistantly spaced from the respective switch contacts 96 and the movable conductor 94 in the device 90, although off-centered arrangements are possible in alternative embodiments. The arc chamber assembly 350 may in some cases be provided as a subassembly for insertion into the housing 92 of the device 90 in one example. The arc chamber assembly 350 also is realized in a compact structure which, in turn, allows for compact fused disconnect switch device 90 to be realized that may safely and reliably operate in electrical power systems operating at 600 VDC or greater, and potentially much greater voltages for use in DC voltage power systems operating at 1000 VDC. In addition to being able to operate in electrical power systems at 600 VDC or greater, magnets 366 and 368 of arc chamber assembly 350 allow fused disconnect switch device 50 to operate bi-directionally. Specifically, arc chamber assembly 350 can interrupt electrical arcs of a given magnitude regardless of a direction of current flow through the device.

Figure 7:
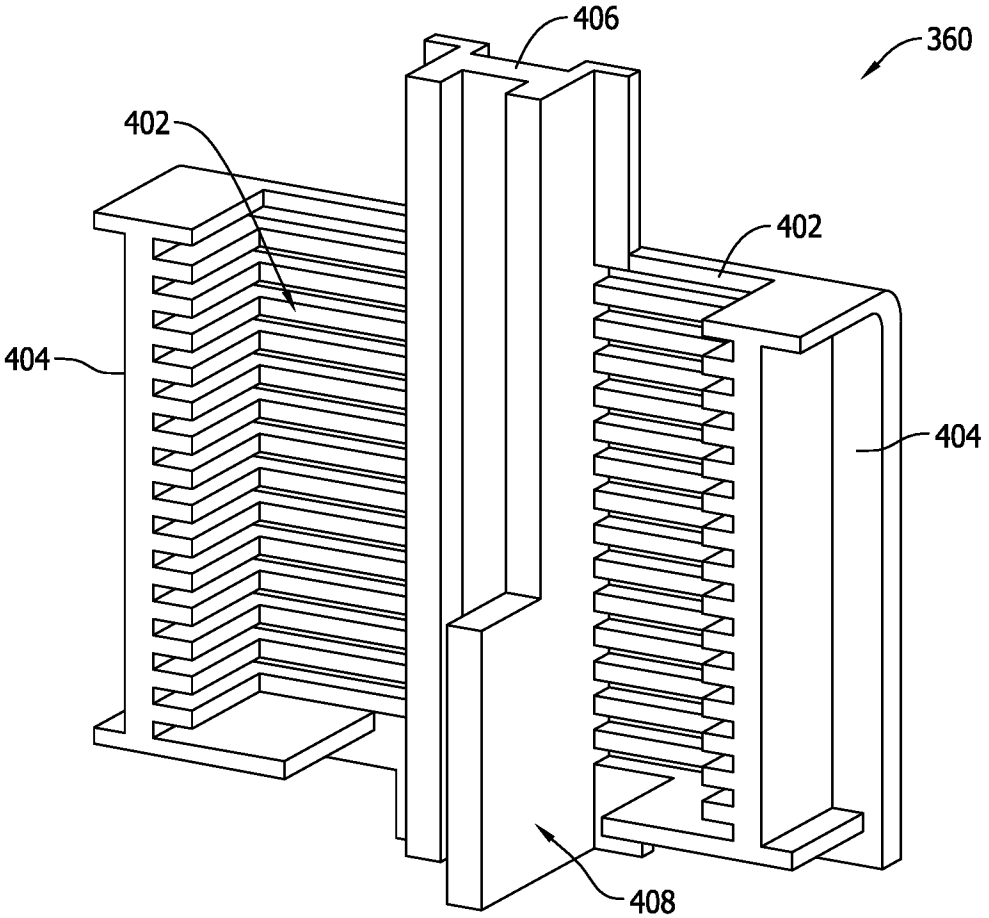
FIG. 7 is a perspective view of an exemplary arc chamber assembly for the fused disconnect switch device shown in FIG. 2B.

FIG. 7 is a perspective view of a first shell 360 of arc chamber assembly 350. The first shell 360 includes arc plate receptacles 402 including a series of parallel slots extending on a portion of a real wall in the shell and also extending along lateral side walls that extend perpendicularly to the rear wall. Arc plates may accordingly be received in each of the slots at the respective side edges and rear edges of the arc plates. The shell 360 is also formed to include respective magnet receptacles 404 on the lateral side walls opposite to the slots, a conductor receptacle 406, and an arc chamber barrier 408 extending perpendicular to the rear wall of the shell 360 and generally parallel to the lateral side walls of the shells 360.

A centrally located sliding guide channel is formed in the rear wall of the shell 360 and extends adjacent the arc chamber barrier 408 on one side thereof. The movable conductor 94 in the fused disconnect switch device 90 may accordingly traverse the path of the guide channel in a linear path of travel to open and close the current path in the device. The guide channel and the arc chamber barrier 408 each extend below a floor of the arc plate receptacles 402 to further extend the length of travel (and associated contact separation distance in the open position) of the movable conductor inside the interior volume of the shell. The extended contact separation increases a path length of electrical arcing when the contacts are opened and accordingly contributes to arc interruption by weakening the arc over a greater contact separation. While the guide channel extends from edge-to-edge in the height dimension (i.e., the vertical dimension in FIG. 7), the arc chamber barrier 408 extends in the height dimension in a substantially lesser amount. The arc chamber barrier 408 is also considerably smaller in the height dimension than the lateral side walls of the shell 360. The guide channel is further seen in the example illustrated to extend above the top edge of the fuse receptacles 402 in the shell 360.

In an exemplary embodiment, arc plate receptacles 402 correspond to the first and second number of arc plates 362 and 364 and magnet receptacles 404 correspond to magnets 366 and 368. Alternatively, first shell 360 can include any number of arc plate receptacles 402 and magnets 366 and 368 that enable fused disconnect switch device 50 to function as described herein. The shell 360 may be assembled with a second shell (not shown in FIG. 7) to collectively define an interior volume therein including the arc plates. The shell, assembled from two shells 360 in this case, provides additional structural strength and reinforcement beyond what the switch housing provides to more capably withstand an increasing severity of arc energy and to effectively interrupt electrical arcs inside the fused disconnect switch device.

In some embodiments, the first shell 360 and the second shell may be identical to each other in order reduce manufacturing costs. In contemplated embodiments, the first shell 360 may interlock with a second shell that is identical to the first shell 360 but reversed so as to extend in a mirror-image relation to the first shell. In this case, the arc chamber barrier 408 in each shell overlap one another inside the shell with the sliding guide channel in the rear wall of each shell extending between the arc barrier chambers 408, and with each arc chamber barrier 408 extending adjacent the leading edge of the arc plate in each chamber opposite the sliding guide channel. The arc plates are received partly in the first shell and partly in the second shell in the receptacles 402. The magnets 366, 368 are likewise respectively received partly in receptacles 404 of the first and second shells, providing an arrangement similar to that shown in FIG. 3B.

While the first shell 360 and second shell as described thus far may be separately provided from the housing of a fused disconnect device (e.g., the housing 92 of FIG. 2B), the respective first and second shell may instead be integrally provided, molded features of the housing, which may in turn be formed to include a case and a cover. In such a case, the magnets 366, 368 may be received in receptacles of the housing case and/or cover that are each formed to complete the arc chamber once assembled.

In other embodiments, arc plate receptacles 402, magnet receptacles 404, conductor receptacle 406, and dual overlapping barriers 408 may be formed as part of first shell 360, with a lid or cover being assembled thereto to contain the arc plates and magnets therein. Regardless, by forming the arc plate receptacles 402 and magnet receptacles 404 as part of a shell 360, the arc chamber assembly 350 captures the arc plates 364 and 364 and secures the magnets 366 and 368 in a desired orientation to produce a magnetic field across the assembly 350. Still further, the barrier 408 in each shell forms an effective barrier between the two arc chambers and still allows the needed motion of the switch contacts 96 in the device 90. Additionally, the overlapping barrier 408 on the first shell 360 cooperates with another overlapping barrier 408 of a second shell 360 to separate the first side 352 and the second side 358 into discrete arc chambers. In this way, arc chamber assembly 350 allows for compact fused disconnect switch devices 50 to be realized that may safely and reliably operate in electrical power systems operating at 600 VDC or greater, and potentially much greater voltages for use in DC voltage power systems operating at 1000 VDC. Further, the magnets 366 and 368 of arc chamber assembly 350 allow fused disconnect switch device 50 to operate bi-directionally.

While an exemplary shell 360 is shaped and formed to produce a particular arrangement of magnets similar to that shown in FIG. 3B, the shell could likewise be formed to realize the magnet arrangement shown in FIG. 4B or FIG. 5B as desired. That is, the magnets may be arranged alongside the longitudinal side walls of the shell or the lateral side walls of the shell. The magnetic shroud and additional pair of magnets may be accommodated with relative ease to realize the different magnetic arc chamber arrangements described with similar manufacturing and performance advantages to those described above.

The benefits and advantages of the inventive concepts disclosed are now believed to have been amply illustrated in relation to the exemplary embodiments disclosed.

A fused disconnect switch device has been disclosed. The fused disconnect switch device includes a housing defining a first interior volume. The housing defines a current path. A fusible element is in electrical communication with the current path. An arc interruption assembly is located in the first interior volume, the arc interruption assembly including a shell defining a second interior volume and at least one barrier in the second interior volume, a first magnet located on a first side of the shell and a second magnet located on a second side of the shell, and a movable conductor located within the shell. The conductor switchably connects or disconnects the current path. The arc interruption assembly also includes at least one arc plate located between the first or second magnet and the conductor. The first and second magnets cooperate to generate a magnetic field across the shell.

Optionally, the fused disconnect switch device may also include a switch actuator selectively positionable between first and second positions to position the movable conductor between connected and disconnected positions. The current path may include at least one switch contact having a stationary turn-back conductive structure.

Optionally, the at least one barrier includes overlapping barriers. The at least one arc plate may be U-shaped. The at least one arc plate may include a leading edge defining a channel and the at least one barrier extending adjacent the leading edge. The conductor may be located approximately equidistant from the first magnet on the first side and the second magnet on the second side.

Optionally, the fused disconnect switch device may also include a ferromagnetic shroud in combination with the first magnet and the second magnet. The first and second magnets may also be configured to facilitate interruption of a first arc between the conductor and the first side of the arc interruption assembly and a second arc between the conductor and the second side of the arc interruption assembly.

Optionally, the first and second magnets as well as the arc plates may be selected to interrupt electrical arc and dissipate electrical arc energy when the current path is exposed to a direct current load of 600 VDC to about 1000 VDC. The current path may further include a first fuse contact member and a second fuse contact member configured to receive an overcurrent protection fuse.

An embodiment of a fused disconnect switch device has also been disclosed. The fused disconnect switch device includes a nonconductive housing configured to accept an overcurrent protection fuse. The fused disconnect switch device includes a current path in the nonconductive switch housing, the current path includes a first fuse contact member and a second fuse contact member, the first fuse contact member and the second fuse contact member configured to complete an electrical connection through the overcurrent protection fuse. The fused disconnect switch device also includes a movable conductor in the current path. A switch actuator is selectively positionable between first and second positions to electrically connect and disconnect the movable conductor in the current path. An arc chamber assembly is disposed about the movable conductor and is separately defined from the nonconductive housing and the arc chamber assembly includes at least one pair of magnets, a first plurality of arc plates, and a second plurality of arc plates. The at least one pair of magnets establishes a magnetic field across the first and second pluralities of arc plates. The first and second stack of arc plates both include a leading edge that at partially defines a channel through which switch actuator passes.

Optionally, the arc chamber assembly includes a shell has includes a first half and a second half wherein the first half and the second half cooperate to define magnet receptacles for receiving the at least one pair of magnets, arc plate receptacles for receiving the first and second pluralities of arc plates and at least one barrier separating a portion of the arc plate receptacles. The at least one barrier may include overlapping barriers extending adjacent each of the arc plate receptacles. The at least one barrier may also be off-centered in the shell and may extend beneath a floor of at least one of the arc plate receptacles.

The overcurrent protection fuse may include a pair of terminal blades insertable into the nonconductive housing along an insertion axis, and the first fuse contact member and the second fuse contact member may receive a respective one of the pair of terminal blades. The movable conductor may carry first and second movable switch contacts on respective ends thereof, the first and second switch contacts completing an electrical path from the current path to the conductor when the switch is in a closed position and disconnecting the conductor from the current path when the switch is in an opened position. The movable conductor may carry first and second movable switch contacts on respective ends thereof, and the current path may include first and second stationary switch contacts having a stationary turn-back conductive structure. The at least one pair of magnets include a first and second magnet located proximate the first plurality of arc plates, and a third and fourth magnet located proximate the second plurality of arc plates. The first and second magnets cooperate with the third and fourth magnets to establish the magnetic field across the first and second pluralities of arc plates.

An embodiment of a fused disconnect switch device has also been disclosed. The fused disconnect switch device includes a housing that defines an interior volume. A current path is defined in the housing, and the current path includes a first fuse contact member, a second fuse contact member, a first stationary switch contact and a second stationary switch contact. The first fuse contact member and the second fuse contact member are configured to complete an electrical connection through an overcurrent protection fuse, and the first stationary switch contact and the second stationary switch contact each have a stationary turn-back conductive structure. An arc chamber assembly includes at least one movable conductive member, a first magnet located on a first side of the arc chamber assembly, a second magnet located on a second side of the arc chamber assembly, the first and second magnets cooperating to generate a magnetic field therebetween, a plurality of arc plates, and a shell including a plurality of receptacles for holding the plurality of arc plates and the first and second magnets Optionally, the fused disconnect switch device includes a switch actuator, the switch actuator moving the movable conductor to complete an electrical path from the conductive member to the current path when the switch is in a closed position and to disconnect the conductive member from the current path when the switch actuator is in an opened position. The first and second magnets as well as the arc plates may be selected to interrupt an electrical arc and dissipate electrical arc energy when the current path is exposed to a direct current load of 600 VDC to about 1000 VDC. The arc chamber assembly may be separately defined from the housing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A fused disconnect switch device comprising:

a housing defining a first interior volume;

a current path defined in the housing for connection to a removable overcurrent protection fuse;

and an arc interruption assembly comprising:

a shell residing in the first interior volume of the housing and defining a second interior volume and at least one barrier defining opposing arc chambers in the second interior volume;

a movable conductor selectively positionable in the housing and relative to the shell, the movable conductor switchably connecting or disconnecting the current path in each of the opposing arc chambers;

arc plates located between the first or second magnet and the movable conductor in the respective opposing arc chambers; and at least first and second magnets generating a magnetic field across the shell to effect arc deflecting magnetic force that does not depend on polarity of connection to a protected circuit;

wherein the current path does not involve or include a resettable circuit breaker element.

2. The fused disconnect switch device of claim 1, wherein the current path further includes a stationary switch contact including a stationary turn-back conductive structure in the opposing arc chambers.

3. The fused disconnect switch device of claim 1, wherein the at least one barrier includes overlapping barriers respectively defining the opposing arc chambers in combination.

4. The fused disconnect switch device of claim 3, wherein the arc plates are U-shaped arc plates.

5. The fused disconnect switch device of claim 4, wherein the arc plates each having a leading edge defining a channel in the respective opposing arc chambers, and the at least one barrier extending adjacent the leading edge of the arc plates.

6. The fused disconnect switch device of claim 1, wherein the shell has opposing lateral sides and opposing longitudinal sides, the first magnet and second magnets arranged on the lateral sides of the shell such that the movable conductor is located approximately equidistant from the first magnet and the second magnet on the respective lateral sides.

7. The fused disconnect switch device of claim 1, the arc interruption assembly further comprising a ferromagnetic shroud.

8. The fused disconnect switch device of claim 1, wherein the movable conductor includes switch contacts on opposing ends thereof, and wherein the first and second magnets are arranged to deflect a first arc and a second arc in the opposing arc chambers when the movable conductor is being selectively positioned.

9. The fused disconnect switch device of claim 1, wherein the arc interruption assembly is designed to interrupt an electrical arc and dissipate electrical arc energy while the current path conducts a direct current load of about 600 VDC to about 1000 VDC.

10. The fused disconnect switch device of claim 1, wherein the current path further comprises a first fuse contact member and a second fuse contact member configured to receive respective terminal blades extending from a common side of the housing of the removable overcurrent protection fuse.

11. A fused disconnect switch device comprising:

a nonconductive housing configured to accept an overcurrent protection fuse;

a current path defined in the nonconductive housing, the current path comprising a first fuse contact member and a second fuse contact member, the first fuse contact member and the second fuse contact member configured to complete an electrical connection through the overcurrent protection fuse;

the current path further including a mechanical switch having a movable conductor but not including a resettable circuit breaker element;

a switch actuator selectively positionable between first and second positions to electrically connect and disconnect the movable conductor in the current path; and an arc chamber assembly disposed about the movable conductor and separately defined from the housing, the arc chamber assembly comprising at least one pair of magnets, a first plurality of arc plates in a first arc chamber, and a second plurality of arc plates in a second arc chamber, the at least one pair of magnets establishing a magnetic field across the arc chamber assembly to effect arc deflecting magnetic force that does not depend on polarity of connection to a protected circuit;

wherein the first and second pluralities of arc plates respectively comprise aligned arc plates having a leading edge defining a channel through which respective ends of the movable conductor pass.

12. The fused disconnect switch device of claim 11, wherein the arc chamber assembly further comprises a shell that is formed to include:

the first arc chamber and the second arc chamber;

magnet receptacles for receiving the at least one pair of magnets;

arc plate receptacles for receiving the first and second pluralities of arc plates in the first arc chamber and second arc chamber; and at least one barrier separating the first arc chamber and the second arc chamber.

13. The fused disconnect switch device of claim 12, wherein the at least one barrier comprises overlapping barriers extending adjacent each of the arc plate receptacles.

14. The fused disconnect switch device of claim 13, wherein the at least one barrier is off-centered in the shell and extends beneath a floor of at least one of the arc plate receptacles.

15. The fused disconnect switch device of claim 11, wherein the overcurrent protection fuse comprises a pair of terminal blades insertable into the nonconductive housing along an insertion axis, and the first fuse contact member and the second fuse contact member receiving a respective one of the pair of terminal blades.

16. The fused disconnect switch device of claim 11, wherein the movable conductor carries first and second movable switch contacts on the respective ends thereof and wherein the current path includes first and second stationary switch contacts having a stationary turn-back conductive structure.

17. The fused disconnect switch device of claim 11, wherein the at least one pair of magnets comprises a first and second magnet located proximate the first plurality of arc plates and a third and fourth magnet located proximate the second plurality of arc plates, the first and second magnets cooperating with the third and fourth magnets to establish the magnetic field across the first and second pluralities of arc plates.

18. A fused disconnect switch device comprising:

a housing defining an interior volume;

a current path defined in the housing, the current path including a first fuse contact member, a second fuse contact member, and a mechanical switch having a first stationary switch contact and a second stationary switch contact and a movable conductor member carrying first and second movable switch contacts on opposed ends thereof, and wherein the current path does not include a circuit breaker;

wherein the first fuse contact member and the second fuse contact member are configured to complete an electrical connection through an overcurrent protection fuse and wherein the first stationary switch contact and the second stationary switch contact each have a stationary turn-back conductive structure; and an arc chamber assembly comprising:

at least first and second magnets cooperating to generate a magnetic field therebetween;

a plurality of arc plates located in the magnetic field; and a shell in the interior volume of the housing and comprising a first arc chamber, a second arc chamber and a plurality of receptacles in the first arc chamber and in the second arc chamber to individually receive the plurality of arc plates, and the shell integrally formed with receptacles to receive the first and second magnets;

wherein the at least first and second magnets effect arc deflecting magnetic force in the first and second arc chamber that does not depend on polarity of connection to a protected circuit.

19. The fused disconnect device of claim 18, further comprising a switch actuator, the switch actuator moving the movable conductor between a closed position and an opened position to connect and disconnect the overcurrent protection fuse in the current path without removal of the fuse from the first fuse contact member and the second fuse contact member.

20. The fused disconnect device of claim 18, wherein the magnetic field and the plurality of arc plates are selected to interrupt an electrical arc and dissipate electrical arc energy while the current path conducts a direct current load of 600 VDC to about 1000 VDC.

* * * * *